US006053755A

United States Patent [19]

Oldfield

[11] Patent Number: 6,053,755

[45] Date of Patent: Apr. 25, 2000

[54] CONNECTOR HAVING AN AXIAL RESILIENT INNER AND OUTER CONDUCTORS

[75] Inventor: William Oldfield, Redwood City, Calif.

[73] Assignee: Anritsu Company, Morgan Hill, Calif.

[21] Appl. No.: 09/120,655

[22] Filed: Jul. 22, 1998

[51] Int. Cl.[7] ..... H01R 13/28

[52] U.S. Cl. ..... 439/289; 439/675

[58] Field of Search ..... 439/675, 578, 439/580, 289

[56] References Cited

U.S. PATENT DOCUMENTS

| | | | |
|---|---|---|---|
| 2,757,351 | 7/1956 | Klostermann | 439/580 |
| 2,762,025 | 9/1956 | Melcher | 439/580 |
| 3,323,083 | 5/1967 | Ziegler | 439/580 |
| 4,799,902 | 1/1989 | Laudig | 439/580 |
| 5,062,808 | 11/1991 | Hosler | 439/580 |
| 5,576,675 | 11/1996 | Oldfield | 333/260 |

*Primary Examiner*—Khiem Nguyen
*Assistant Examiner*—Javaid Nasri
*Attorney, Agent, or Firm*—Fliesler, Dubb, Meyer & Lovejoy LLP

[57] ABSTRACT

A microwave coaxial connector having both inner and outer axial resilient conductors is provided. The connector may be used for connecting a microwave device to a coaxial cable without causing damage to the microwave device housing or degrading a transmitted microwave signal. The inner axial resilient conductor includes an inner cylindrical conducting member having an inner bore formed by a plurality of fingers. A cylindrical contact member includes a first end for inserting into the inner bore. The outer axially resilient conductor includes an outer cylindrical conducting member circumjacent about the inner conductor forming a ring-shaped opening. An outer contact member having a plurality of fingers is inserted in the ring-shaped opening to provide an outer resilient conductor. A connector for connecting adjacent devices is also provided. This connector includes a pair of inner and outer resilient conductors positioned at opposite ends of the connector. The connector eliminates the need of selecting and cutting coaxial cable as well as using soldering, ribbon bonding or screws in connecting adjacent microwave devices.

10 Claims, 7 Drawing Sheets

CONNECTOR HAVING AN AXIAL RESILIENT INNER AND OUTER CONDUCTORS

CROSS-REFERENCE TO RELATED APPLICATIONS

The following U.S. patent is assigned to the assignee of the present application, is related to the present application and its disclosures are incorporated herein by reference:

(A) U.S. Pat. No. 5,576,675 issued Nov. 19, 1996 by William W. Oldfield and entitled "Microwave Connector With An Inner Conductor That Provides An Axially Resilient Coaxial Connection".

BACKGROUND OF THE INVENTION

1. Field of the Invention

The present invention relates to connectors, and more particularly, microwave coaxial connectors having inner and outer conductors.

2. Description of the Related Art

FIG. 1A illustrates a microwave coaxial transmission cable 10 which has two contacts for connecting to a microwave device. One contact is an outer conductor 11 and the other contact is an inner conductor 12. Typically, the outer conductor is used for a ground connection and the inner conductor carries a microwave signal. Both of these conductors form an axial connection with a microwave device. That is, to make a pressure connection with the microwave device, pressure is provided in the direction of the central axis 13 of the inner and outer conductors.

In an axial connection, typically one conductor is firm, while the other conductor is resilient as depicted in FIG. 1B. Typically, a resilient conductor retracts or deforms as axial pressure is exerted between the conductor and another conductor or contact surface. FIG. 1B is a side view of outer conductors 11*a–b* and inner conductors 12*a–b* of two microwave coaxial transmission cables 17 and 18, respectively. A firm connection 14 exists between the outer conductors 11*a–b* while a resilient connection 15 exists between the inner conductors 12*a–b*. The resilient connection 15 is necessary to absorb the variations in contact surface and angle of contact between the outer conductors 11*a–b* and inner conductors 12*a–b*. Also, the resilient connection 15 should generally be maintained at a requisite amount of axial pressure 16 in order to provide constant impedance for any signals transmitted on cables 17 and 18.

The above-identified and incorporated by reference U.S. Pat. No. 5,576,675 entitled "Microwave Connector With An Inner Conductor That Provides An Axially Resilient Coaxial Connection", describes various coaxial connectors having an inner axially resilient conductor, such as a GPC-7 connector.

However, having an outer conductor firm while the inner conductor is resilient may cause a number of problems. First, the outer conductor may damage a housing during the insertion of the connector. FIG. 2 illustrates a conventional N-type connector 20 inserted into housing 21. One of ordinary skill in the art understands that connector 20 includes a large number of components which are not illustrated in order to clearly illustrate the present invention. Connector 20 includes a main component 20*b* having threads 22. Threads 22 are used to insert connector 20 into housing 21. Connector 20 includes outer conductor 23 and inner conductor 24. Typically, outer conductor 23 is used for a ground and inner conductor 24 is used to carry a microwave signal. Outer conductor 23, in particular surface 26 of outer conductor 23, contacts surface 27 of housing 21 after connector 20 is inserted into housing 21. If outer conductor 23 is used as a ground and housing 21 is grounded, a common ground is formed between conductor 23 and housing 21. Inner conductor 24 is coupled to extendable pin 25. FIG. 2 illustrates connector 20 having an extendable pin 25 rather than an axial resilient pin as described below. Pin 25 overlaps and contacts microstrip 30 rather than forming an axial resilient contact with microstrip 30. After inserting connector 20 into housing 21, pin 25 contacts microstrip 30 on substrate 31 in order to form an electrical connection between microstrip 30 and connector 20, in particular inner conductor 24. In this extendable pin connector 20, contact surface 29 of inner conductor 24 contacts housing 21 at housing surface 28. As described below in regard to the outer conductor, inner conductor 24 may likewise damage housing 21 at housing surface 28 during insertion and lead to damaged internal components and/or erroneous signals.

If inner conductor 24 is axial resilient, pressure is axially exerted between inner conductor 24 (and pin 25) and microstrip 30. Because the inner conductor is axially resilient, the inner conductor 24 retracts or deforms during insertion and does not damage housing 21 at housing surface 28. Further, the inner axially resilient conductor provides a constant pressure and enables relatively constant impedance at the contact position between pin 25 and microstrip 30.

However, outer conductor 26 is not axially resilient. Thus when connector 20 is inserted into housing 21, a force is exerted on housing 21 at the housing surface 27. The insertion force is concentrated on a relatively small housing surface area 27 due to the gap 32 between connector 20 housing 21. This force may be large enough to damage housing 21. This damage to the housing could increase after repeated insertions of connector 20. Electronic components or lines adjacent to housing surface 27 may likewise be damaged. Further, damage to the housing 21 may affect electrical connections between conductors 23 and 24, and housing 21 and microstrip 30, respectively, which may introduce noise or reduce signal strength in a transmitted microwave signal.

Another typical problem encountered with microwave coaxial connectors regards connecting two microwave components. Often a microwave coaxial cable is used to connect two microwave components. However, the coaxial cable length must be selected so as to connect the two components without using excess cable. The excess cable may cause errors or unwanted noise in the microwave signals. Alternatively, if a cable length is selected and cut which is too short, the cable may have to be scraped.

Also, some microwave coaxial connectors for connecting microwave components may require screws, soldering, or ribbon bonding which increases manufacturing costs and complexity. The soldering or ribbon bonding may also affect transmitted signal quality.

Thus, it is desirable to provide a connector which does not damage device housings during insertion which could lead to electronic component damage or erroneous signal transmission. The connector should also provide a predetermined pressure at contact surfaces after insertion in order to maintain constant impedance. Also, a connector for easily connecting microwave components without using costly coaxial cable, screws, soldering or ribbon bonding, is desirable.

SUMMARY OF THE INVENTION

A connector having an inner axial resilient conductor and an outer axial conductor is provided. The connector does not damage a device housing or internal components when inserted. Further, a connector is provided which connects adjacent microwave device components without using a coaxial cable, screws, soldering, or ribbon bonding.

According to one aspect of the present invention, a connector comprises an inner cylindrical conductor and an outer cylindrical conductor. The outer cylindrical conductor is circumjacent about the inner cylindrical conductor and forms a ring-shaped opening. An outer contact member is inserted into the ring-shaped opening for providing an axial resilient contact. The outer contact member includes a plurality of fingers for inserting into the ring-shaped opening. The outer cylindrical conductor has a sliding RF contact surface at an inner surface.

According to another aspect of the present invention, a microwave connector is provided. The microwave connector includes an inner cylindrical conducting member having a plurality of fingers forming an inner bore. An inner contact member has a first end which may be inserted into the inner bore. An outer cylindrical conducting member is circumjacent about the inner conducting member. The outer cylindrical conducting member and inner cylindrical conducting member form a ring-shaped opening. An outer contact member having a plurality of fingers may then be inserted into the ring-shaped opening.

According to another aspect of the present invention, the inner contact member's first end contacts the inner cylindrical conducting member fingers to produce a pressure along a central axis of the inner contact member as the inner contact member is inserted into the inner bore.

According to another aspect of the present invention, the inner cylindrical conducting member has a proximal and distal end and the plurality of fingers extend longitudinally from the proximal end to the distal end forming the inner bore.

According to still another aspect of the present invention, a microwave coaxial connector for mating with a microwave device housing is provided. The microwave coaxial connector includes an inner cylindrical conductor and an outer cylindrical conductor. The inner cylindrical conductor includes an inner cylindrical conducting member having a proximal end and distal end. The inner cylindrical conducting member includes a plurality of fingers extending longitudinally from the proximal end to the distal end forming an inner bore. An inner cylindrical conducting member then may be inserted into the inner bore. The outer cylindrical conductor includes an outer cylindrical conducting member which is circumjacent about the inner cylindrical conductor. The outer cylindrical conducting member has a distal end and a proximal end. The outer cylindrical conducting member includes a plurality of fingers extending longitudinally from the proximal end to the distal end forming a ring-shaped opening between the outer cylindrical conducting member fingers and the inner cylindrical conducting member. An outer cylindrical contact member may be inserted into the ring-shaped opening providing an outer axial resilient contact.

According to still a further aspect of the present invention, a microwave system is provided. The microwave system includes a vector network analyzer. A coaxial cable is coupled to the vector network analyzer. A microwave device having a housing is connected to the coaxial cable by a connector. The connector includes an inner cylindrical conductor and an outer cylindrical conductor which provide an inner and outer axial resilient contact between the connector and the microwave device housing.

According to another aspect of the present invention, a connector for providing a connection between two microwave devices is provided. The connector comprises a central conductor. A first inner cylindrical conducting member having a first end and a second end is coupled to the center conductor, wherein the center conductor is coupled to the second end. The first inner cylindrical conducting member has a plurality of fingers extend longitudinally from the second end to the first end forming a first inner bore. A first cylindrical contact member may be inserted into the first inner bore. A first outer cylindrical conducting member is circumjacent about the first inner cylindrical conducting member. The first outer cylindrical conducting member has a first end and a second end. The first outer cylindrical conducting member has a plurality of fingers extend longitudinally from the second end to the first end to form a first ring-shaped opening. A first outer contact member may be inserted into the first ringed shaped opening. A second inner cylindrical conducting member is coupled to the center conductor. The second inner cylindrical conducting member has a first end and a second end, wherein the second end is coupled to the center conductor. The second inner cylindrical conducting member has a plurality of fingers extend longitudinally from the second end to the first end forming a second inner bore. A second cylindrical contact member may be inserted into the second inner bore. A second outer cylindrical conducting member is circumjacent about the second inner conducting member. The second outer cylindrical conducting member has a first end and a second end wherein the second end is coupled to the central conductor. The second outer cylindrical conduct member has a plurality of fingers extend longitudinally from the second end to the first end forming a second ring-shaped opening. A second outer contact member may be inserted into the second ring-shaped opening.

DETAILED DESCRIPTION

Figure 3A:
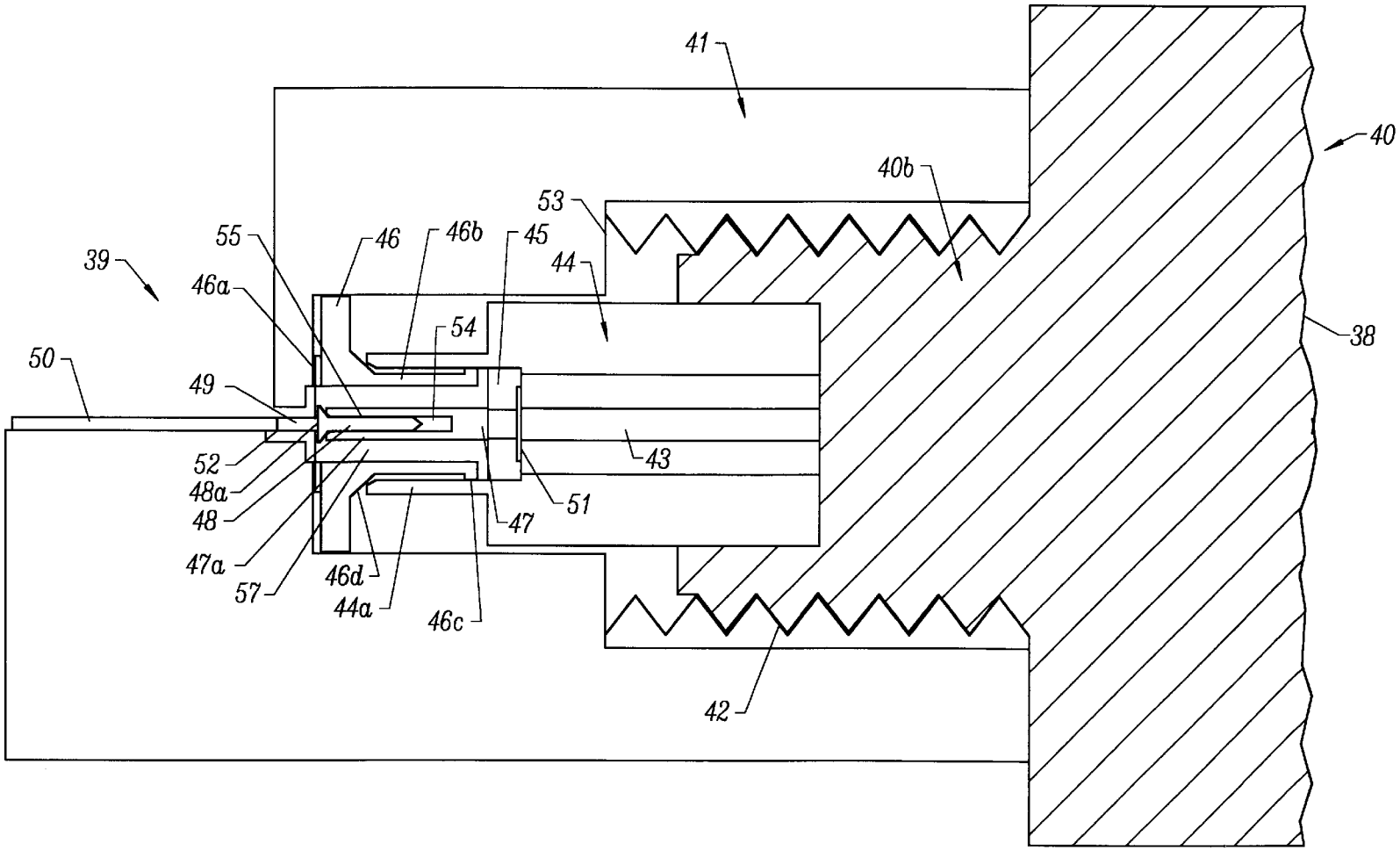
FIG. 3A illustrates a side view of a connector having an inner axial resilient and outer axially resilient conductor according to the present invention.
Figure 5:
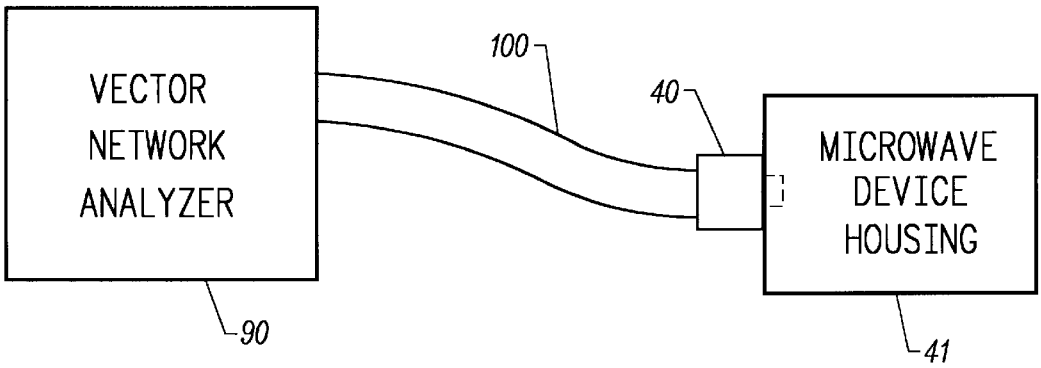
FIG. 5 illustrates an inner and outer axially resilient connector according to the present invention which connects a vector network analyzer to a microwave device.

FIGS. 3A and 5 illustrate a connector 40 according to the present invention. FIG. 3A illustrates a microwave coaxial connector 40 having an inner axial resilient conductor and outer axial resilient conductor. FIG. 5 illustrates how connector 40 is used, in an embodiment, to couple a vector network analyzer 90 to a microwave device in housing 41.

Typically, microwave housing 41 is made of aluminum or brass. Microwave coaxial cable 100 is coupled to vector network analyzer ("VNA") 90 and is likewise coupled to connector 40. VNA 90 may transmit or receive microwave signals, such as a 60 GHz signal, to or from connector 40. Connector 40 is coupled to microwave device housing 41 to provide an electrical connection between VNA 90 and microwave device housing 41. In an embodiment, microwave device 41 may be a coupler, modulator, or amplifier. In an embodiment, microstrip 50 is an input/output transmission line to a microwave component. In an embodiment, microstrip 50 is approximately 0.25 mm wide.

FIG. 3A illustrates connector 40 inserted into microwave device housing 41, in particular housing opening 53. In an embodiment, connector 40 is rotated clockwise in order to mate connector threads 42 to housing 41. In alternate embodiments, other equivalent structures may be used to mate connector 40 to housing 41, such as a plug-in structure instead of threads. After inserting connector 40 into housing 41, conductors of connector 40 are able to provide electrical connections between components in housing 41 and connector 40 as described in detail below.

Connector 40 has a proximal end 38 and distal end 39, wherein base 40*b* is positioned at the proximal end 38. In order to clearly illustrate the present invention, many components and features known by one of ordinary skill in the art of coaxial microwave connectors are not illustrated in FIG. 3A and are represented by base 40*b*. In an embodiment, base 40*b* includes the components of a GPC-7 connector. Base 40*b* includes threads 42 for mating to microwave device housing 41. Connector 40 has a distal end 39 having conductors for contacting housing 41 and microstrip 50.

Connector 40 includes an inner axial resilient conductor and outer axial resilient conductor. The inner conductor includes inner cylindrical conducting member 47 and inner contact member 48. In an embodiment, inner cylindrical conducting member 47 is made out of beryllium copper plated with rhodium and inner contact member 48 is made out of beryllium copper plated with gold. The outer conductor includes outer cylindrical conductor 44 and outer contact member 46. In an embodiment, outer cylindrical conductor 44 is made out of beryllium copper plated with rhodium and outer contact member 46 is made out of beryllium copper plated with gold. Inner cylindrical conducting member 47 is coupled to center conductor 43. In an embodiment, center conductor 43 is made out of beryllium copper plated with gold. Base 40*b* is coupled to center conductor 43 and outer cylindrical conductor 44.

Support bead 45 with compensation 51 is positioned about inner cylindrical conducting member 47 and in ring-shaped opening 57 before outer contact member 46 is inserted. Bead 45 is a donut-shaped component used to support inner cylindrical conducting member 47 which is relatively small and fragile. Bead 45 is able to support inner cylindrical conducting member 47 and reduce vibrations during insertion of connector 40. Bead compensation 51 reduces mismatches due to geometry changes. In an embodiment, bead compensation 51 is only formed on the proximal side of bead 51 to reduce impedance mismatch. Generally, impedance mismatch is anything which causes reflections in a transmission line, such as change in geometry or transmission line type.

Inner cylindrical conducting member 47 includes a plurality of semi-cylindrical fingers 47*a*. In an alternate embodiment, fingers 47*a* may not be in the form of a semi-cylindrical member. The plurality of semi-cylindrical fingers form an inner bore 54 at the distal end of inner cylindrical conducting member 47. In an embodiment, conducting member 47 includes four fingers forming an inner bore 54 having a inner diameter of approximately 0.3 mm. In an embodiment, the distance between each finger or slot is approximately 0.08 mm. Inner cylindrical conducting member 47 is used to position inner contact member 48. In an embodiment inner, contact member 48 has a tapered head 48*a* at the distal end and has a proximal end for inserting into bore 54. Contact member 48 is flattened at the distal end and is coupled to pin 49 which is made out of beryllium copper in an embodiment.

The above-described and other types of inner axial resilient conductors are described in the above identified incorporated by reference U.S. patent entitled "Microwave Connector With An Inner Conductor That Provides An Axial Resilient Coaxial Connection".

Figure 1A:
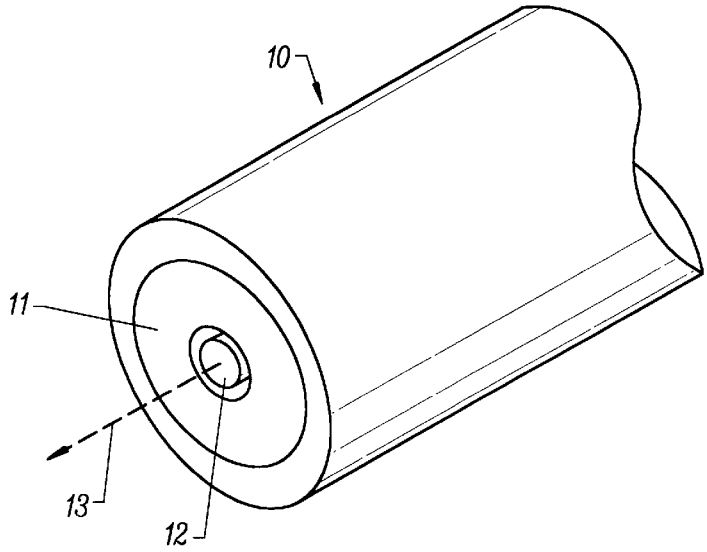
FIG. 1A (PRIOR ART)
FIG. 1A illustrates a perspective view of a coaxial transmission cable.
Figure 1B:
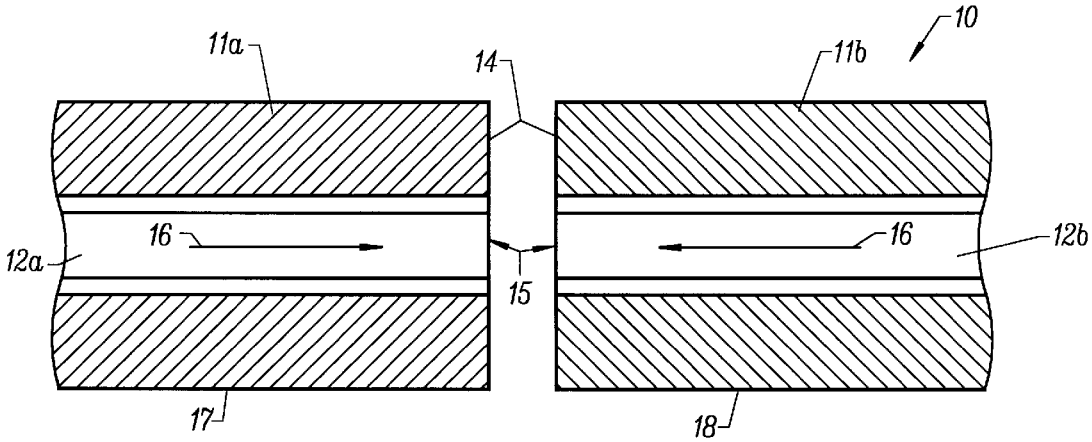
FIG. 1B (PRIOR ART)
FIG. 1B illustrates a side view of two coaxial transmission cables.
Figure 2:
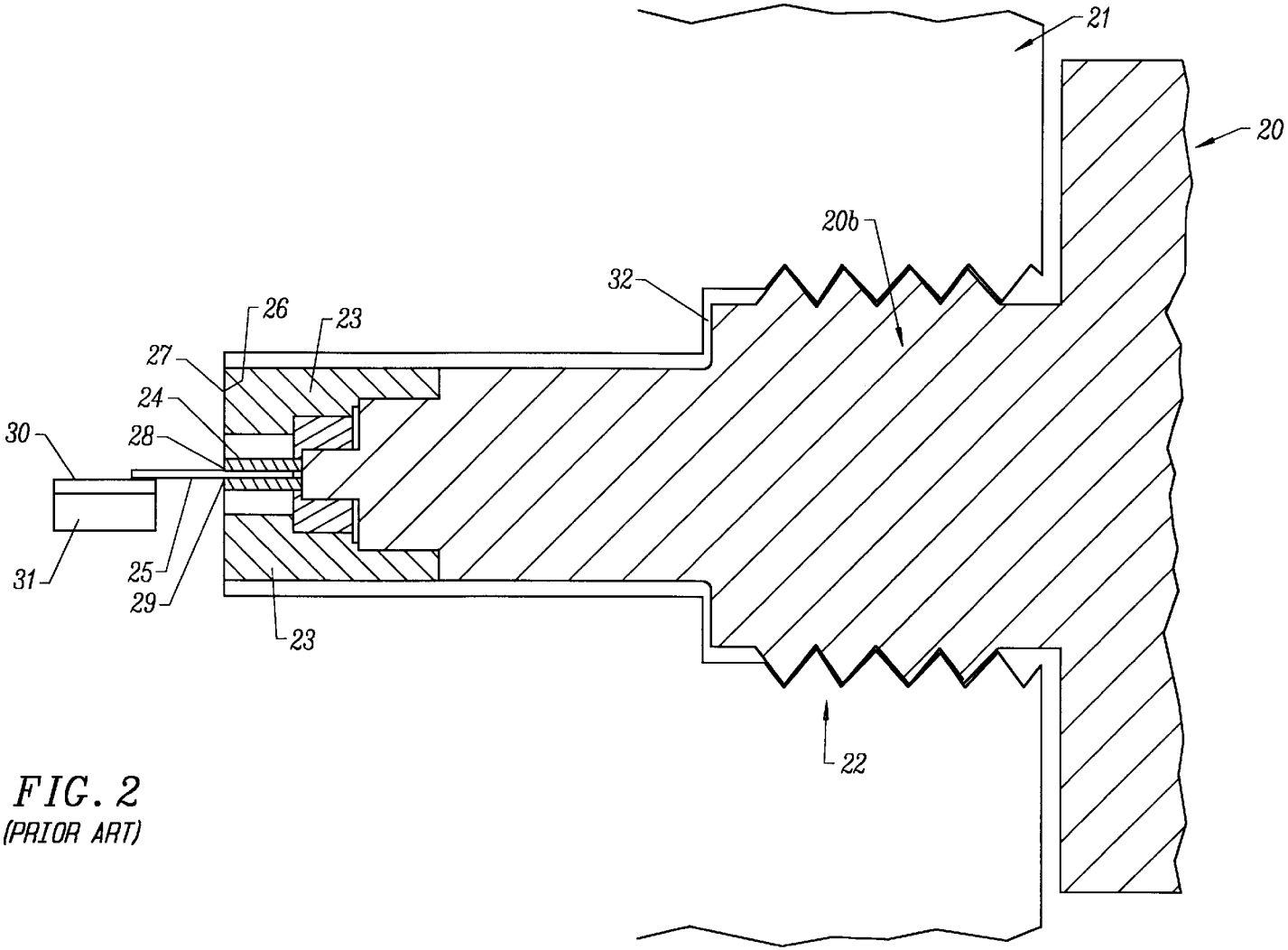
FIG. 2 (PRIOR ART)
FIG. 2 illustrates a side view of a microwave connector inserted into a housing.
Figure 3B:
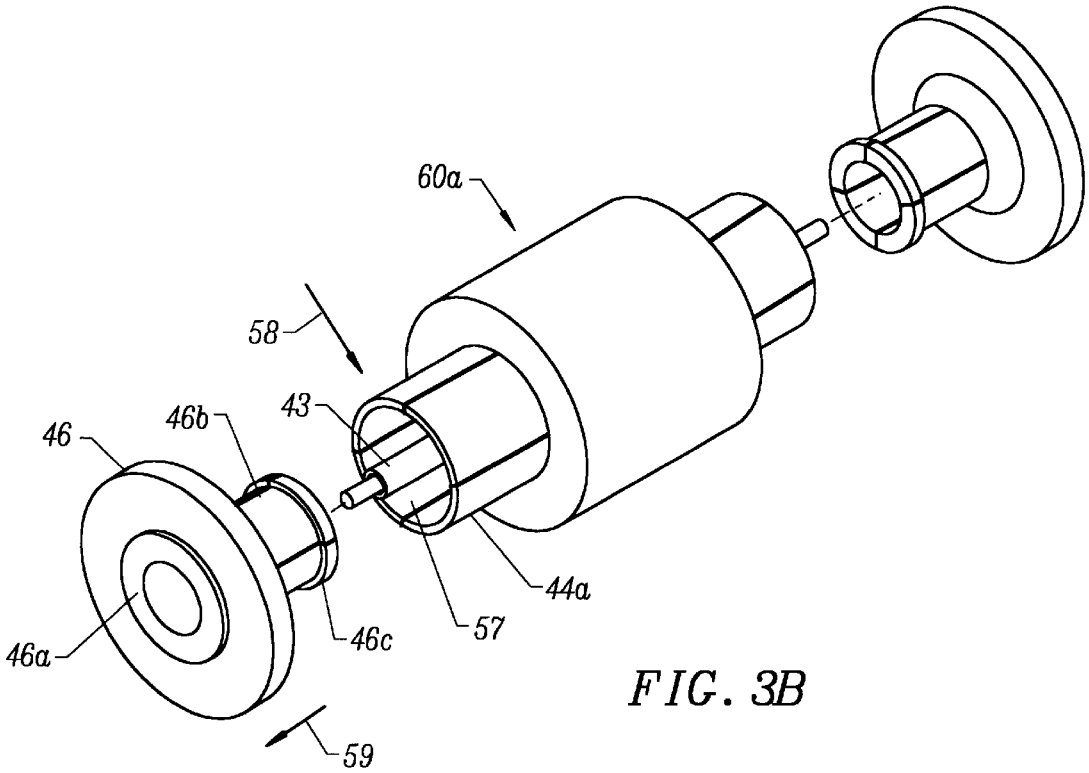
FIG. 3B illustrates a perspective view of a connector having an outer axially resilient conductor according to the present invention.
Figure 3D:
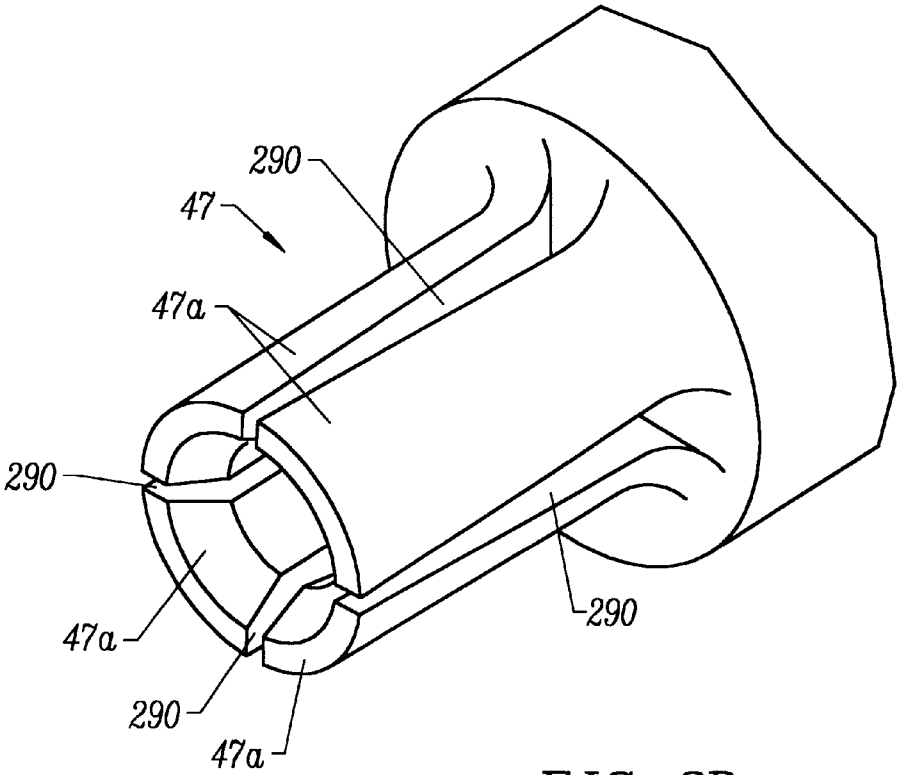
FIGS. 3C–D illustrates a front view and perspective view of an inner cylindrical conducting member, respectively.
Figure 3C:
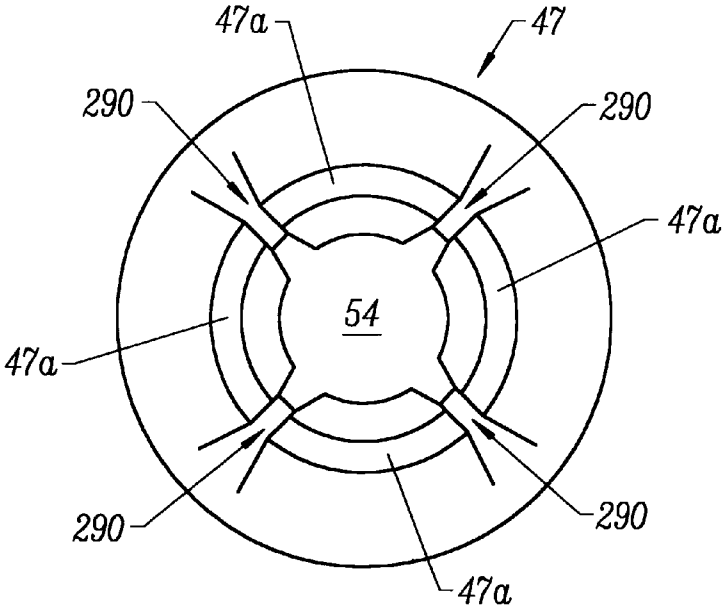

For example, FIG. 2C shows a front view of the proximal end of the inner cylindrical conducting member 47 of the present invention. The slots 290 of the inner cylindrical conducting member 47 form the fingers 47*a* of the cylindrical conducting member 47. FIG. 3D shows a perspective view of the proximal end of the inner cylindrical conducting member 47. The slots 290 form the fingers 47*a* of the inner cylindrical conducting member 47.

The inner axial resilient conductor of connector 40 provides a relatively constant pressure contact 52 between pin 49 and microstrip 50 after and during insertion of connector 40. A RF contact surface is formed between inner contact member 48 and inner cylindrical conducting member 47 at surface 55. The relatively constant pressure and relatively uniform diameter of the inner conductor caused by the inner cylindrical conducting member 47 slightly spreading the fingers 47*a* to a preferred size enables a constant impedance at contact 52. Thus, a microwave signal may be transmitted from conducting member 47 to contact member 48 and eventually to microstrip 50 by way of pin 49 without degrading signal quality.

The axial resilient nature of the inner conductor also enables contact 52 to having a constant pressure after inserting connector 40 while not damaging housing 41 or microstrip 50. Soldering, screws or ribbon bonding which may complicate manufacturing, increased cost of manufacturing and reduce signal quality are not required. In an embodiment, microstrip 50 may be a portion of a microwave circuit component or input-output microwave transmission line.

The outer axial resilient conductor operates similarly to the inner axial resilient conductor. Pressure is exerted axially toward contact washer 46*a* and against housing 41 as fingers 46*b* are inserted into ring-shaped opening 57. Fingers 44*a* open up slightly and the distal ends of fingers 44*a* move against ramp 46*d* of outer contact member 46. An air gap is provided between the fingers 46*b* and bead 45 for compensation after outer contact member 46 is inserted into ring-shaped opening 57.

An outer axial resilient conductor is provided by outer cylindrical conductor 44 and outer contact member 46. FIG. 3B illustrates a perspective view of outer contact member 46 and outer cylindrical conductor 44 including outer semi-cylindrical fingers 44*a*. FIG. 3B does not illustrate the inner resilient conductor illustrated in FIG. 3A. Outer cylindrical conductor 44 includes outer semi-cylindrical fingers 44*a* as illustrated in FIG. 3B. The plurality of fingers 44*a* extend longitudinally from the proximal end of outer conducting member 44 to the distal end. The plurality of fingers 44*a* form a ring-shaped opening 57 with an inner conductor. In an embodiment, ring-shaped opening has an inner diameter of approximately 2.5 mm and an outer diameter of approximately 4 mm. In an embodiment, outer fingers 44*a* includes six semi-cylindrical fingers having a slot of approximately 0.2 mm between each finger. Outer fingers 44*a* are circumjacent with inner conducting member 47 and inner contact member 48.

Outer contact member 46 including a washer contact 46*a* at the distal end and a plurality of fingers 46*b* at the proximal end. The outer diameter at the distal end of outer contact member 46 is sized such that outer contact member 46 is able to be inserted into opening 53 of housing 41 while allowing for manufacturing size and surface tolerances of opening 53. The plurality of fingers 46*b* form an opening having an inner diameter of approximately 2.5 mm. In an embodiment, there are four fingers 46*b* having a slot width of approximately 0.2 mm between each finger 46*b*. At the proximal end of fingers 46*b* is a semi-cylindrical ridge 46*c* for forming a RF contract with the inner surface of outer fingers 44*a*. Outer contact member ridge 46*c* is inserted into ring-shaped opening 57 in order to provide a axial resilient contact point between the surface of contact washer 46*a* and housing 41. The slots width in the fingers 46*b* and 44*a* are relatively small, such as 0.2 mm in order to reduce impedance mismatch.

FIG. 3B illustrates inserting outer contact member 46 into outer fingers of connector 60*a*. Connector 60*a* has an outer conductor similar to the outer conductors illustrated in FIG. 3A and 4. Connector 60*a* does not illustrate the inner conductors shown in FIGS. 3A and 4. Outer contact member 46 is similarly inserted into fingers 44*a* as shown in FIG. 3A. Outer contact member 46 is inserted into ring-shaped opening 57 formed by outer fingers 44*a*. As the ridge 46*c* of outer contact member 46 makes contact with an inner surface of outer fingers 44*a* a pressure in the direction of 58 is produced towards the center of opening 57. The radial pressure of the outer fingers 44*a*, in turn produces axial pressure in the axial direction 59 substantially perpendicular to the radial pressure direction 58. The axial pressure is in the direction 59 away from the proximal end 38 and toward the distal end 39 of outer cylindrical conducting member 44. The axial pressure produces an axial resilient connection between the outer conducting member 46 and housing 41.

The inner and outer axial resilient conductors described above are practical and inexpensive to manufacture and provides sufficient axial pressure despite being relatively small. The inner and outer axial resilient conductors provide relatively constant pressure at the surface contacts between connector 40 and housing 41 (or microstrip 50) enabling a constant impedance for signal transmission. The inner and outer axial resilient conductor also provides for relatively uniform contact if housing 41 is manufactured with slight misalignments or irregularities. Screws, soldering or ribbon bonding are not required in using the inner or outer axial resilient conductor. Further, the axial resilient coaxial conductors will not damage or deform housing 41 during the insertion of connector 40.

Figure 4:
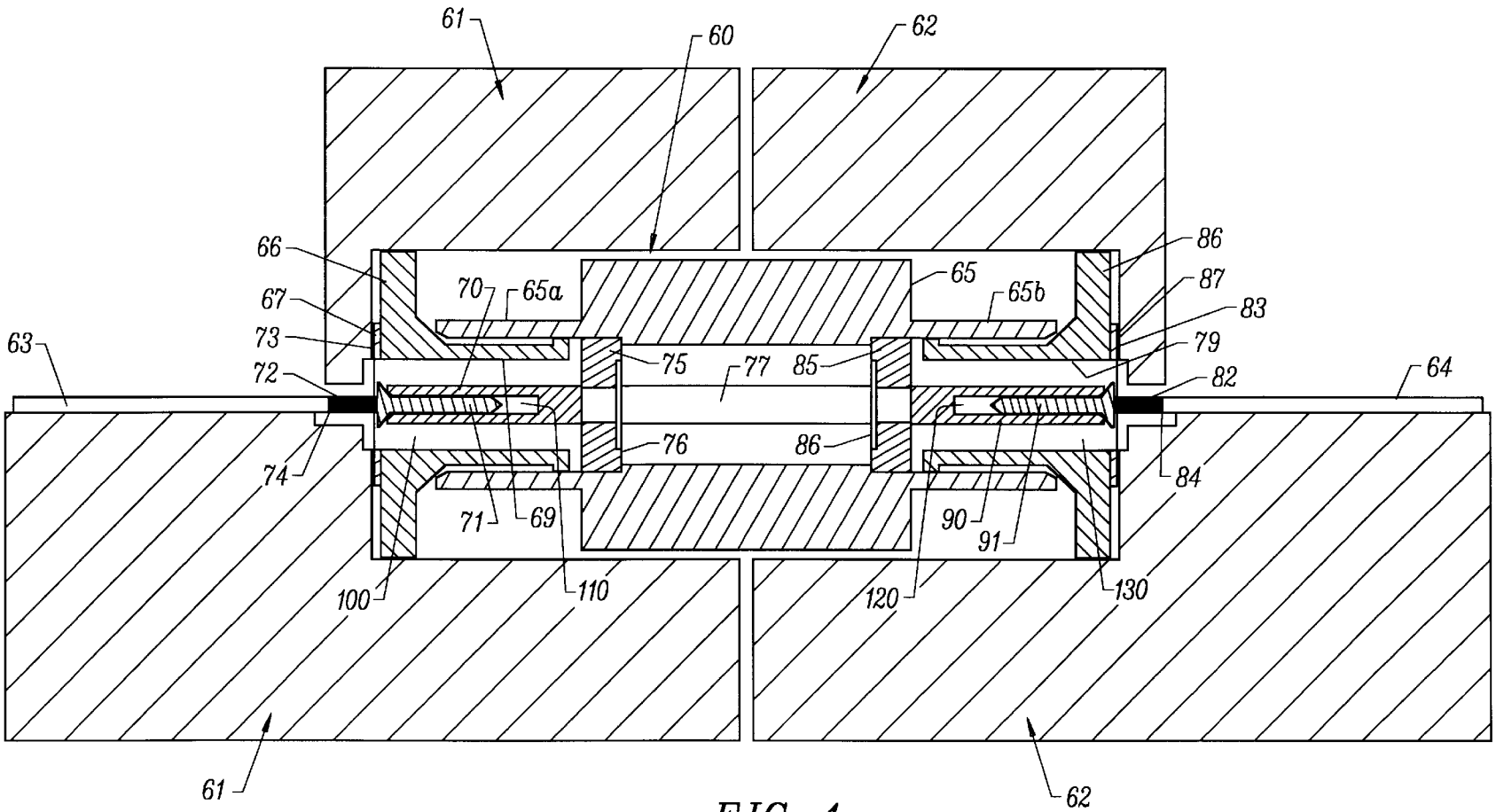
FIG. 4 illustrates a side view of a connector having opposing pairs of inner axially resilient and outer axially resilient conductors.

FIG. 4 illustrates a connector 60 for connecting two microwave devices. In particular, connector 60 couples microwave devices in housings 61 and 62. In an embodiment, microwave devices in housing 61 and 62 are splitters and antennas, respectively. In an embodiment, connector 60 is used in a phase array radar system where as many as 7,000 subsystems must be connected electronically. FIG. 4 illustrates how microstrip 63 in microwave device 61 is coupled to microstrip 64 in microwave device 62. In an embodiment, microstrips 63 and 64 are components of microwave input/output circuitry in housing 61 and 62, respectively.

Connector 60 eliminates the need of using microwave coaxial cable in connecting two microwave devices. As described above, the use of excessive microwave cable in connecting microwave device may introduce additional cost in manufacturing and noise into a microwave signal. Further, selecting and cutting microwave cable which is not of adequate length generates undue scraps. Similarly, screws, soldering or ribbon bonding is not required in using the connector. Also, connector 60 includes a pair of inner axial resilient and outer axial resilient conductors which do not cause damage to housing 61 and 62 during or after insertion. Moreover, a constant pressure is exerted at the contact surfaces between connector 60 and housings 61 and 62 enabling constant impedance for transmitting a signal.

Connector 60 includes outer cylindrical conductor 65 having a plurality of fingers 65*a* forming a ring-shaped opening 100 for position outer contact member 66 on a first side of connector 60. Outer cylindrical conductor 65 is similar to outer cylindrical conductor 44 illustrated in FIGS. 3A–B. Likewise, outer conductor 65 includes a plurality of fingers 65*b* forming a ring-shaped opening for positioning outer contact member 86 on a second side, or opposite side, of connector 60. As described above and illustrated in FIGS. 3A–B, outer contact members 66 and 86 include outer washer contact 67 and 87 for forming a contact at surface 73 and 83 of housing 61 and 62, respectively. Outer contacting members 66 and 86 have a plurality of fingers for inserting into ring shaped openings 100 and 130, respectively.

Inner resilient conductors are provided by inner cylindrical conducting members 70 and 90, and also inner contact members 71 and 91, respectively. Inner contact members 71 and 91 include a first end and second end. The first ends of inner contact members 71 and 91 are coupled to pins 72 and 82, respectively. Pins 72 and 82 form a pressure contact with microstrips 63 and 64 at surface 74 and 84, respectively. The second end of inner contact members 71 and 91 are positioned by inner bores 110 and 120, respectively, which are formed by a plurality of fingers. Inner cylindrical conducting member 70 and inner contact member 71 are on the first side of connector 60 and provide an axial resilient contact as described above. Inner cylindrical conductor member 90 and inner contact member 91 are positioned on the second side of connector 60 and also form an axial resilient contact as described above. Other axial resilient inner conductors may also be used for connector 60 as described in the above incorporated by reference U.S. patent entitled "Microwave Connector With An Inner Conductor That Provides An Axial Resilient Coaxial Connection".

Inner cylindrical conducting members 70 and 90 are coupled to center conductor 77 for providing a signal, such as a microwave signal, between housing 61 and 62. In the preferred embodiment, conducting members 70, 90 and 77 are one part. Support beads 75 and 85 are used to support inner cylindrical conducting member 70 and 90. Bead compensation 76 and 86 are positioned toward the center of connector 60 in order to compensate for the gap between the outer contact members 66 and 86.

In an embodiment, center conductor 77, inner conducting member 70 and inner conducting member 90 are positioned along a common central axis.

In an embodiment, the materials used for components illustrated in FIGS. 3A–B are likewise used for similar components in connector 60, housings 61 and 62. The number of fingers and sizes of components illustrated in FIGS. 3A–B are also used for connector 60.

As described above, the pair of opposing outer contact members 66 and 86 and inner contact members 71 and 91 provide axial pressure against respective housings (or microstrips) as the contact members are inserted into respective housing openings. If the openings to housing 61 and 62 are slightly irregular, conductor 60 is able to adjust to the manufactured irregularity and still provide a relatively constant pressure at respective contact surfaces.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A connector, comprising:

a central conductor;

a first inner cylindrical conducting member, coupled to the center conductor, having a first end and a second end, wherein a plurality of fingers extend longitudinally from the second end to the first end forming a first inner bore;

a first cylindrical contact member having a first end for inserting into the first inner bore;

a first outer cylindrical conducting member, circumjacent about the first inner cylindrical conducting member, having a first end and second end, wherein a plurality of fingers extend longitudinally from the second end to the first end forming a first ring-shaped opening;

a first outer contact member for inserting into the first ring-shaped opening;

a second inner cylindrical conducting member, coupled to the center conductor, having a first end and a second end, wherein a plurality of fingers extend longitudinally from the second end to the first end forming a second inner bore;

a second cylindrical contact member having a first end for inserting into the second inner bore;

a second outer cylindrical conducting member, circumjacent about the second inner conducting member, having a first end and second end, wherein a plurality of fingers extend longitudinally from the second end to the first end forming a second ring-shaped opening; and a second outer contact member for inserting into the second ring-shaped opening.

2. The connector of claim 1, wherein the first cylindrical contact member first end contacts the first inner cylindrical conducting member fingers to produce pressure along a central axis of the first inner cylindrical contact member.

3. The connector of claim 1, wherein the second cylindrical contact member first end contacts the second inner cylindrical conducting member fingers to provide pressure along a central axis of the second inner cylindrical contact member.

4. The connector of claim 1, wherein the first outer contact member has four fingers.

5. The connector of claim 1, wherein the first outer cylindrical conducting member has six fingers.

6. The connector of claim 1, wherein the first inner cylindrical conducting member has four fingers.

7. The connector of claim 1, wherein the second outer contact member has four fingers.

8. The connector of claim 1, wherein the second outer cylindrical conducting member has six fingers.

9. The connector of claim 1, wherein the second inner cylindrical conducting member has four fingers.

10. The connector of claim 1, wherein the connector is positioned between a first housing and a second housing, and wherein the first outer contact member forms a contact with the first housing, and the second outer contact member form a contact with the second housing.

* * * * *